US006823888B1

(12) United States Patent
Raymond

(10) Patent No.: US 6,823,888 B1
(45) Date of Patent: Nov. 30, 2004

(54) TELESCOPIC BOOM-MOUNTED CONCRETE PUMP APPARATUS

(75) Inventor: Timothy J. Raymond, Sarasota, FL (US)

(73) Assignee: Glazer Enterprises, Inc., Omaha, NE (US)

( * ) Notice: Subject to any disclaimer, the term of this patent is extended or adjusted under 35 U.S.C. 154(b) by 2 days.

(21) Appl. No.: 10/614,880

(22) Filed: Jul. 7, 2003

Related U.S. Application Data

(63) Continuation-in-part of application No. 10/045,106, filed on Jan. 7, 2002, now Pat. No. 6,588,448.

(51) Int. Cl.[7] ..... E04G 21/04

(52) U.S. Cl. ..... 137/351; 137/615; 222/608; 222/527

(58) Field of Search ..... 137/351, 615; 222/608, 527

(56) References Cited

U.S. PATENT DOCUMENTS

| | | | | |
|---|---|---|---|---|
| 3,707,990 | A | 1/1973 | Schaible et al. | 137/615 |
| 3,712,330 | A | 1/1973 | Davis | 137/312 |
| 3,893,480 | A | 7/1975 | Dunbar | 137/615 |
| 4,262,696 | A | 4/1981 | Oury | 137/615 |
| 4,418,713 | A | 12/1983 | Schlecht | 137/615 |
| 4,488,683 | A | 12/1984 | Chiel | 239/199 |
| 4,502,505 | A | 3/1985 | Moller | 137/615 |
| 4,640,533 | A | 2/1987 | Klemm | 137/615 |
| 4,708,533 | A | 11/1987 | Leppanen | 405/303 |
| 5,460,301 | A | 10/1995 | Ebinger et al. | 222/626 |
| 5,558,118 | A | 9/1996 | Mooring | 137/342 |
| 5,640,850 | A | 6/1997 | Benckert et al. | 137/884 |
| 5,823,218 | A | 10/1998 | Schlecht et al. | 137/1 |
| 5,913,323 | A | 6/1999 | Hudelmaier | 137/1 |
| 6,142,180 | A | 11/2000 | Woodling et al. | 137/615 |
| 6,220,292 | B1 | 4/2001 | Woodling et al. | 137/615 |
| 6,463,958 | B1 | 10/2002 | Schwing | 137/615 |
| 6,588,448 | B1 | 7/2003 | Raymond | 137/351 |

FOREIGN PATENT DOCUMENTS

| | | | |
|---|---|---|---|
| JP | 10236780 A | 9/1998 | B66C/23/88 |
| JP | 11172919 A | 6/1999 | E04G/21/04 |

OTHER PUBLICATIONS

Putzmeister "Building Success Concrete Pumping Systems" brochure, undated.

*Primary Examiner*—Kenneth Bomberg
(74) *Attorney, Agent, or Firm*—Thomte, Mazour & Niebergall; Dennis L. Thomte

(57) ABSTRACT

A telescopic boom-mounted concrete pump is provided wherein a telescoping boom assembly is pivotally and rotatably mounted on the platform of the truck. The boom assembly includes inner, intermediate and outer boom members. A first concrete conduit which is in fluid communication with a source of pressurized concrete is mounted at one side of the inner boom member for movement therewith. A normally U-shaped flexible concrete hose has its inlet end thereof connected to the discharge end of the first concrete conduit. A rigid concrete conduit has its inlet end connected to the discharge end of the flexible concrete hose. A jib boom member in the form of a concrete discharge conduit is pivotally and rotatably connected to the outer end of the outer boom member and is in fluid communication with the rigid concrete conduit. The jib boom member is secured to and is positioned within a lattice truss. A winch is selectively removably secured to the outer end of the lattice truss.

45 Claims, 11 Drawing Sheets

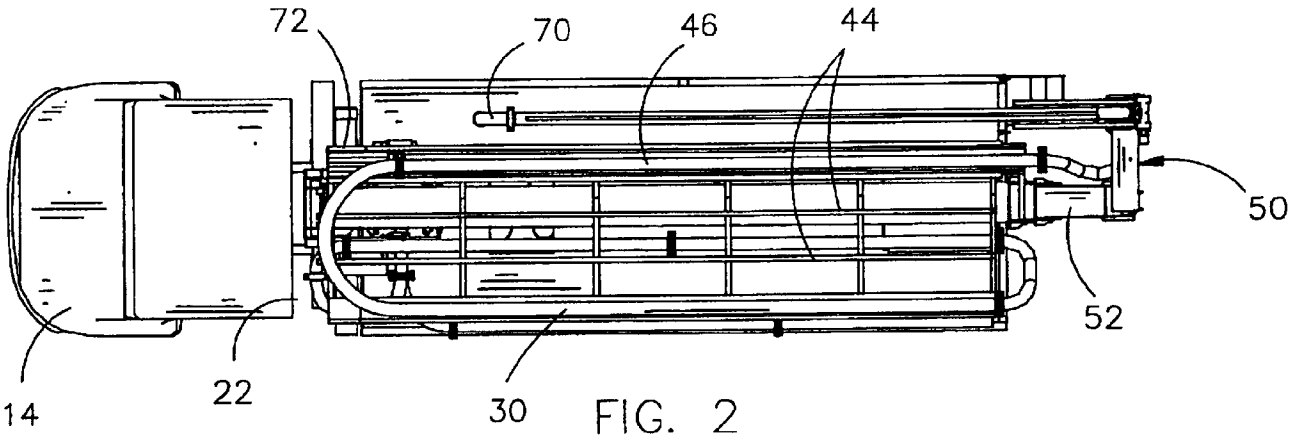
FIG. 2
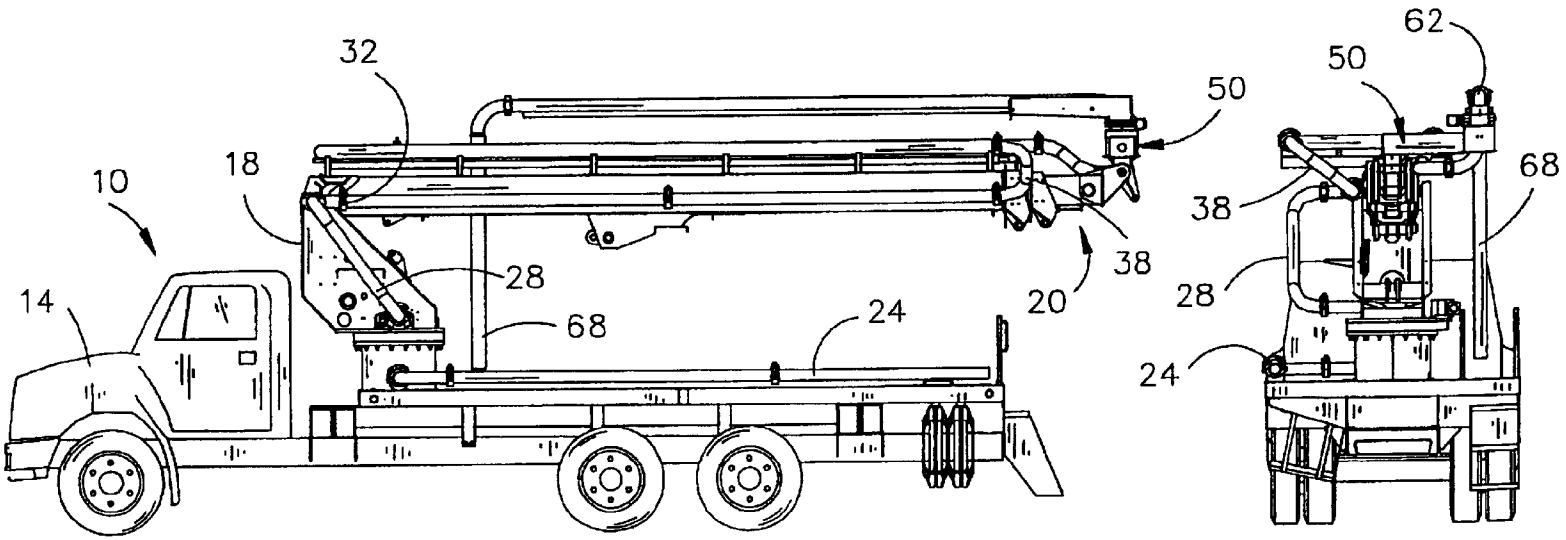
FIG. 3
FIG. 4

TELESCOPIC BOOM-MOUNTED CONCRETE PUMP APPARATUS

CROSS-REFERENCE TO RELATED APPLICATION

This is a continuation-in-part application of Petitioner's earlier application Ser. No. 10/045,106 filed Jan. 7, 2002, now U.S. Pat. No. 6,588,448 entitled "A TELESCOPIC BOOM-MOUNTED CONCRETE PUMP APPARATUS".

BACKGROUND OF THE INVENTION

1. Field of the Invention

This invention relates to a concrete pump apparatus and more particularly to a telescopic boom-mounted concrete pump apparatus. Even more particularly, the apparatus includes a concrete discharge conduit in the form of a rigid jib boom member which is mounted on the outer end of the boom assembly. The rigid jib boom member is secured to and positioned within a lattice truss. A winch is secured to the outer end of the lattice truss.

2. Description of the Related Art

Concrete is sometimes pumped to locations where it is difficult or impossible for a concrete mixer truck to gain access thereto. Such is the case where concrete is to be poured behind a house or the like where it is impossible to drive the concrete mixer truck. One alternative to such a situation is to use wheelbarrows to transport the concrete to the location where it is to be placed. Another solution has been to utilize a telescoping or articulated boom assembly which is mounted on a truck. In some cases, a concrete pump is positioned on the truck and a concrete conduit, such as a flexible hose, is extended from the pump, along the length of the telescoping boom, at the exterior surface thereof, to a discharge conduit from which the concrete is discharged. The telescoping boom is extended and maneuvered to position the discharge conduit at the proper location.

The assignee of the present invention is the owner of U.S. Pat. No. 6,142,180 entitled A CRANE-MOUNTED CONCRETE PUMP APPARATUS as well as U.S. Pat. No. 6,220,292 entitled A CRANE-MOUNTED CONCRETE PUMP APPARATUS. In U.S. Pat. No. 6,142,180, a flexible hose extends between the discharge side of the concrete pump and the rearward end of the concrete conduit positioned within the telescopic boom assembly. The flexible hose is coiled on the crane platform when not in use. As the telescopic boom is extended, the flexible hose is pulled from the coil of the interior of the boom assembly. When the boom assembly is retracted, it is necessary to pull the hose rearwardly from the interior of the boom assembly and position the same on the crane platform. In U.S. Pat. No. 6,220,292, the flexible hose connecting the concrete pump with the concrete conduit within the boom assembly is wound upon a powered hose reel, rotatably mounted on the rearward end of the boom assembly. An improved telescopic boom-mounted concrete pump apparatus is disclosed in co-pending application Ser. No. 10/045,106 filed Jan. 7, 2002. Although both of the above-identified patents represent a significant advance in the art, the invention of the co-pending application eliminates the need for coiling the flexible hose on the crane platform and eliminates the need for a powered hose reel. In addition, the invention of the co-pending application is more maneuverable than the devices of the above-identified patents.

Although the invention of the co-pending application truly represents an improvement in the field, the instant invention is believed to represent an improvement thereover since the jib boom member is strengthened with a lattice truss which also permits a winch to be mounted on the outer end of the truss, providing additional versatility to the apparatus.

SUMMARY OF THE INVENTION

A telescopic boom-mounted concrete pump apparatus is provided with the apparatus being mounted on a truck having a rotatable pedestal assembly mounted thereon rearwardly of the cab of the truck. A telescoping boom assembly is pivotally secured to the pedestal and extends outwardly and normally upwardly therefrom. A hydraulic cylinder pivotally connects the telescoping boom assembly to the pedestal for pivotally moving the telescoping boom assembly with respect to the pedestal. The telescoping boom assembly preferably comprises an inner boom member, an intermediate boom member slidably mounted in the interior of the inner boom member, and an outer boom member slidably mounted in the interior of the intermediate boom member. For purposes of description, the inner boom member will be described as having inner and outer ends and first and second sides while the intermediate and outer boom members will be described as having inner and outer ends. The outer boom member is movable with the intermediate boom member as the intermediate boom member is retracted and extended.

A first concrete conduit, having inner and outer ends, is positioned at the outer side of the inner boom member with the inner end of the first concrete conduit being positioned at the inner end of the inner boom member. The outer end of the first concrete conduit is positioned at the outer end of the inner boom member. The inner end of the first concrete conduit is in communication with a source of concrete under pressure. One end of a flexible concrete hose is operatively connected to the outer end of the first concrete conduit. A first elongated support is mounted on the inner boom member at the first side thereof. A second elongated support is mounted on the inner boom member at the second side thereof. A third elongated support is movably mounted on the second elongated support and is movable between retracted and extended positions with respect to the second elongated support.

The outer end of the third elongated support is secured to the intermediate boom member so that the third elongated support moves from its retracted position to its extended position as the intermediate boom member is moved from its retracted position to its extended position. The inner end of a second concrete conduit is in fluid communication with the second end of the flexible concrete hose with the outer end of the second concrete conduit being secured to the outer end of the outer boom member for movement therewith. The second concrete conduit is positioned on the third elongated support when the outer boom member is in its retracted position. The second concrete conduit extends from the outer end of the third elongated support when the outer boom member is in its extended position. The flexible concrete hose is positioned on the first elongated support and at least partially positioned upon the second elongated support when the intermediate and outer boom members are in their retracted positions.

A concrete discharge conduit in the form of a rigid jib boom member is pivotally and rotatably secured to the outer end of the outer boom member and includes a self-aligning mechanism which normally maintains the rigid jib boom member in a pivotal aligned relationship with respect to the truck. A flexible concrete discharge hose is secured to the outer end of the, rigid jib boom member. The construction of the apparatus of this invention enables the boom assembly to be moved into low buildings with the jib boom member being able to pivot around pillars, columns or the like. Further, the arrangement of the various components allows concrete to be discharged at a location dose to the truck.

The jib boom member is secured to and is positioned within a lattice truss which strengthens the jib boom member and which permits a winch to be mounted on the outer end of the lattice truss thereby creating additional versatility for the apparatus.

It is therefore a principal object of the invention to provide an improved concrete pumping apparatus.

A further object of the invention is to provide a telescopic boom-mounted concrete pump apparatus.

Still another object of the invention is to provide a telescopic boom-mounted concrete pump apparatus wherein the telescopic boom may be extended into low buildings.

Yet another object of the invention is to provide an apparatus of the type described which includes a pivotal jib boom member which may be pivoted around obstructions within the building.

A further object of the invention is to provide an apparatus of the type described which includes a truss reinforced jib boom member or placer jib boom.

A further object of the invention is to provide an apparatus of the type described which includes a truss reinforced jib boom member or placer jib boom thereby enabling a lifting eye or winch to be mounted on the outer end thereof.

These and other objects will be apparent to those skilled in the art.

BRIEF DESCRIPTION OF THE DRAWINGS

FIG. 2 is a top view of the apparatus of FIG. 1;

FIG. 3 is a side view of the apparatus of FIG. 1;

FIG. 4 is a rear view of the apparatus of FIG. 1;

DESCRIPTION OF THE PREFERRED EMBODIMENT

Figure 1:
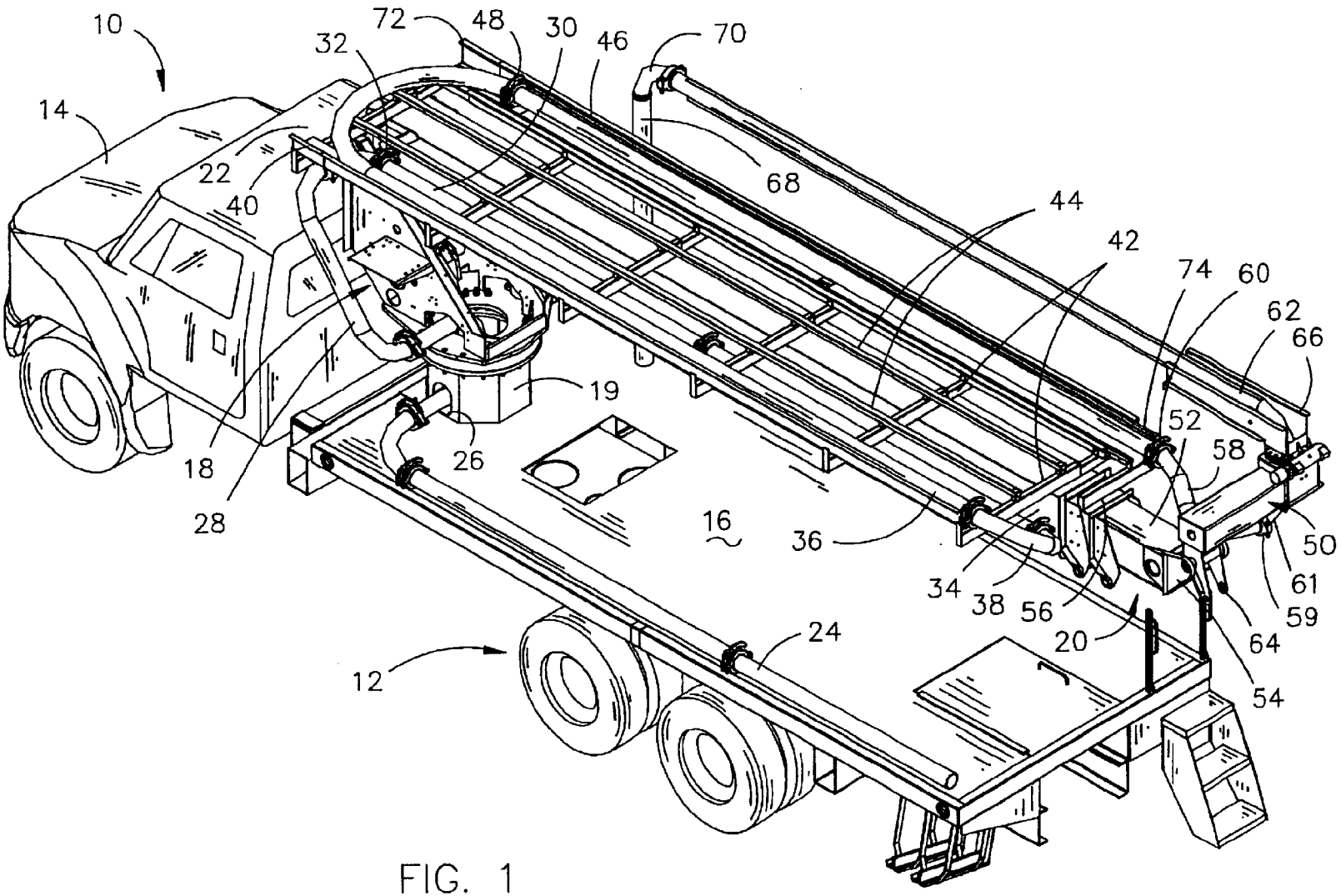
FIG. 1 is a rear perspective view of one embodiment of this invention.
Figure 5:
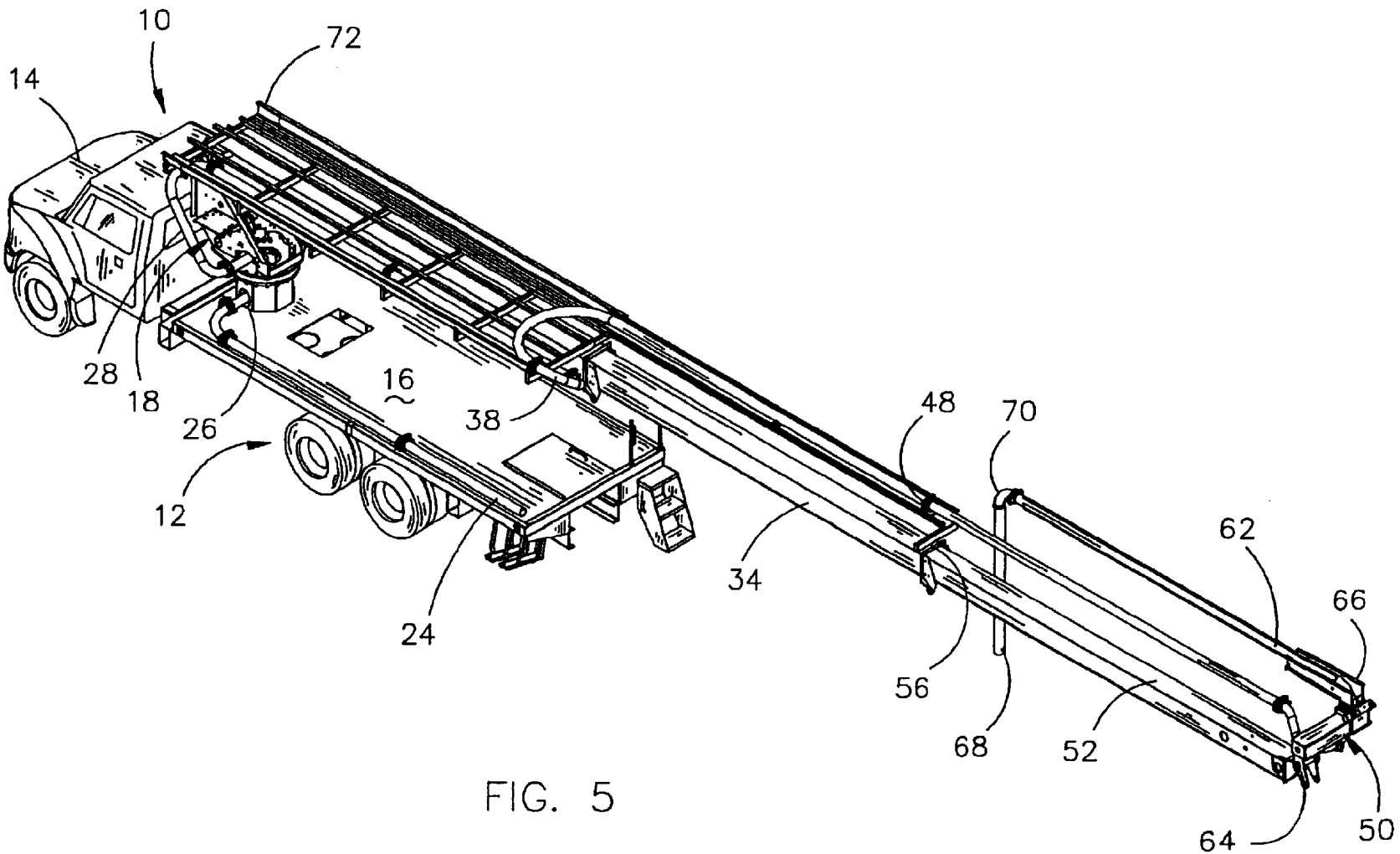
FIG. 5 is a rear perspective view of the apparatus of FIG. 1 illustrating the intermediate and outer boom members being in an extended position.
Figure 6:
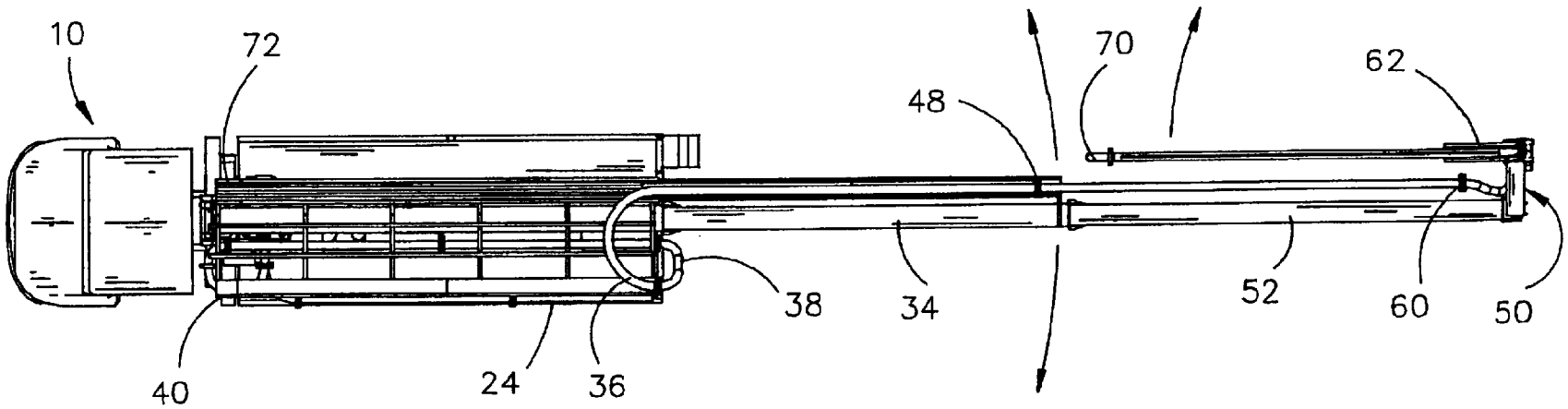
FIG. 6 is a top view of the apparatus of FIG. 5 with the arrows indicating possible movement of the telescopic boom assembly and the jib boom assembly.
Figure 7:
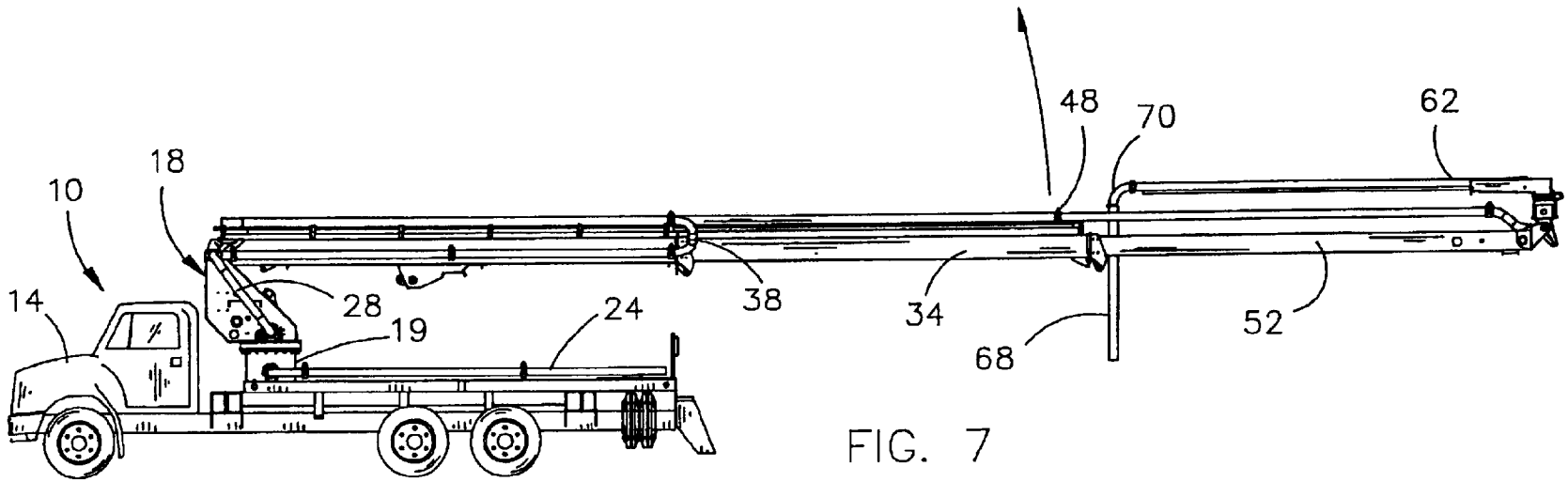
FIG. 7 is a side view of the apparatus of FIGS. 5 and 6 with the arrow indicating the upward possible movement of the telescopic boom assembly.
Figure 8:
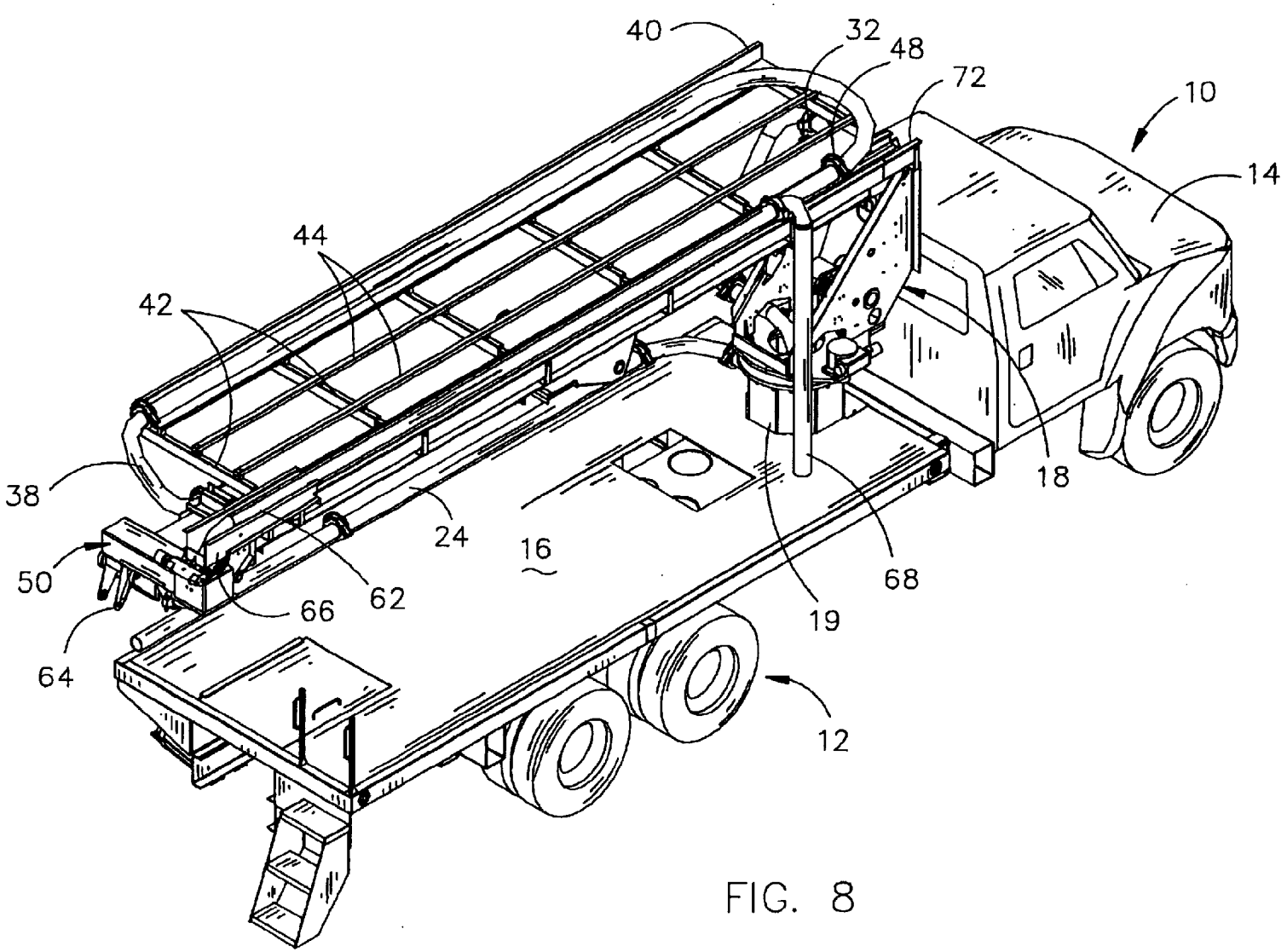
FIG. 8 is a rear view of the apparatus of FIG. 1 with the telescopic boom in a retracted position and the jib boom member in its stored position.
Figure 9:
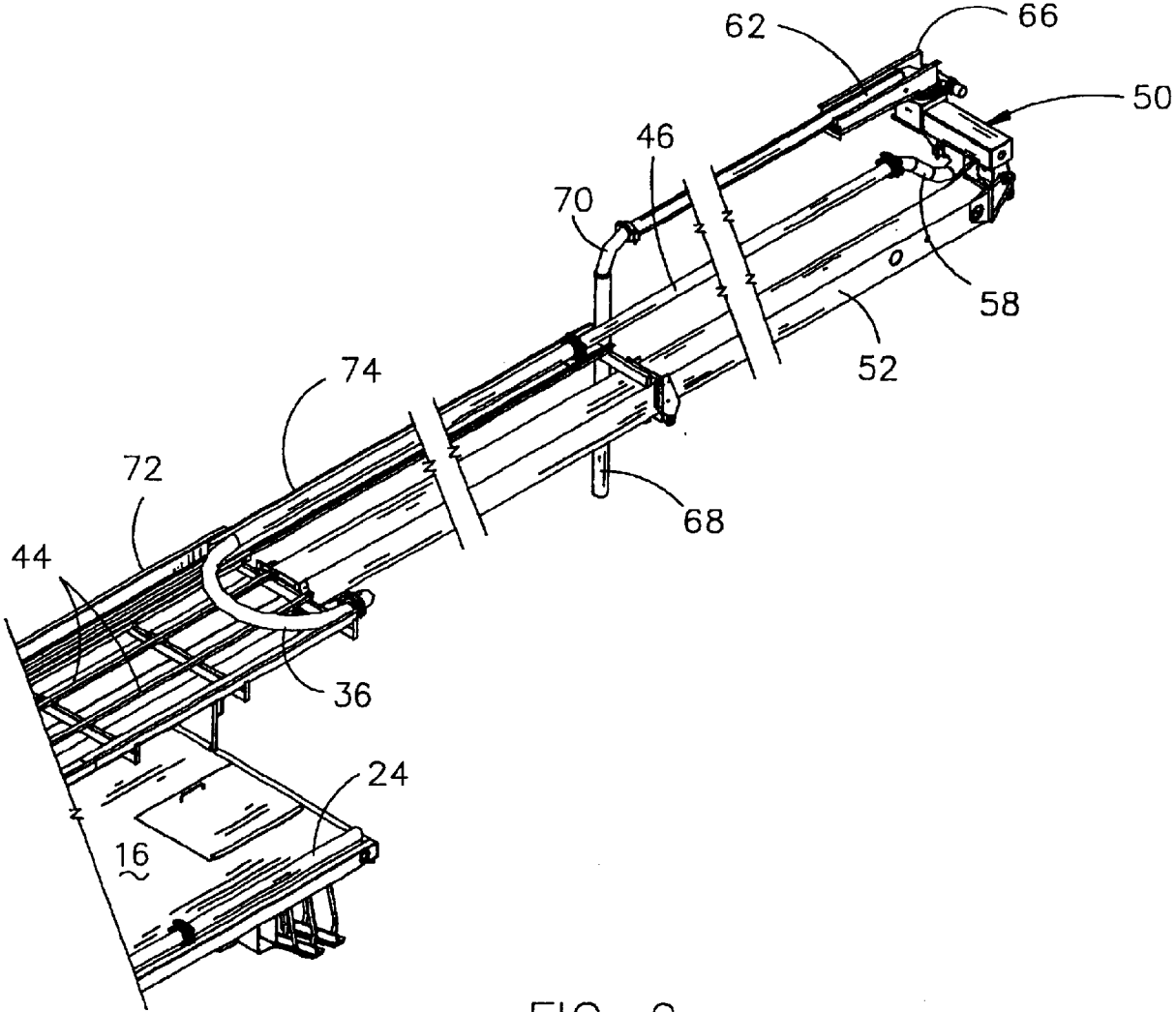
FIG. 9 is a partial perspective view of the apparatus of FIG. 1 with the boom member in an extended position and the jib boom in a folded position.

A first embodiment of the invention is illustrated in FIGS. 1–9 and is the embodiment disclosed in co-pending application Ser. No. 10/045,106 filed Jan. 7, 2002. Referring to FIGS. 1–9, the numeral 10 refers to a truck including a wheeled frame means 12 and a cab 14 mounted at the forward end thereof. Platform 16 is provided at the rearward end of the truck. The numeral 18 refers to a conventional crane pedestal which is rotatably mounted on the truck in conventional fashion. Pedestal 18 is positioned on base 19. The numeral 20 refers generally to a telescoping boom assembly which is pivotally mounted at the upper end of the pedestal 18 at 22 and which has a hydraulic cylinder extending therebetween in conventional fashion for pivotally moving the boom assembly 20 with respect to the pedestal 18.

A conventional concrete pump would be mounted at the rear end of the truck and would have a discharge conduit 24 extending therefrom. Concrete conduit 24 extends into the pedestal base 19 at 26 and extends outwardly from the upper end of the pedestal, as seen in the drawings. A swivel connection is provided in the concrete conduit 24 within the pedestal 18 and base 19 to enable the concrete conduit portion 28 to rotate with respect to the concrete conduit 26 within pedestal 18 and base 19. The upper end of concrete conduit portion 28 has a rotational connection 29 aligned with the boom pivot to allow rotational movement of the upper end of the concrete conduit portion 28. The rotational connection 29 is connected to a rigid concrete conduit 30 at 32 with the concrete conduit 30 being supported at one side of the inner boom member 34 of boom assembly 20. The outer end of concrete conduit 30 is connected to one end of a flexible concrete hose 36 by an elbow 38.

When the boom assembly 20 is in its retracted position, as illustrated in FIG. 1, a portion of the flexible hose 36 rests in and is supported on an L-shaped support which is operatively secured to the inner boom member 34 by means of cross braces 42 which are secured to inner boom member 34. Elongated support bars 44 are secured to the cross braces 42 and extend along the length of the boom member 34, as illustrated in the drawings. The other end of the flexible concrete hose is connected to a rigid concrete conduit in the form of a metal tube or pipe 46 at 48. A box-shaped frame member 50 is pivotally secured, about a horizontal axis, to the outer end of outer boom member 52 at 54. Outer boom member 52 is telescopically mounted within intermediate boom member 56 which is telescopically received within inner boom member 34 in conventional fashion.

One end of concrete conduit 58 is connected to the end of concrete conduit 46 at 60. The other end of concrete conduit 58 is rotationally connected to concrete conduit 61 by means of swivel joint 59 which is aligned with pivot 54 between the outer boom member 52 and frame member 50. Concrete conduit 61 extends into the outer end of the frame member 50 and is fluidly connected to concrete conduit 62 which extends from frame member 50 by means of a swivel joint connection within frame member 50. A hydraulic cylinder is operatively connected to frame member 50 at 64 and would also be pivotally connected to outer boom member 52 to pivotally move frame member 50 with respect to outer boom member 52. A support assembly 66 is rotatably mounted on the outer end of the frame member 50 so that the support 66 and the concrete conduit 62 may be rotatably moved with respect to the frame member 50 and the boom assembly 20. Concrete conduit 62 is in the form of a jib boom member of metal construction. The outer end of conduit 62 has a flexible discharge hose 68 connected thereto by means of an elbow 70.

The numeral 72 refers to an elongated support which is positioned on the cross braces 42 for movement with inner boom member 34. An elongated support 74 is slidably mounted within the support 72 and has its outer end operatively connected to the outer end of intermediate boom member 56. Thus, as intermediate boom member 56 is moved from its retracted position within inner boom member 34, support 74 moves from its retracted position to its extended position. Preferably, the conduit 46 is provided with a guide or the like which engages the support 74 to maintain the conduit 46 in its proper relationship within support 74.

When the boom assembly is in its retracted position, the flexible hose 36 is generally U-shaped. As the boom assembly is extended, the hose 36!tends to roll or straighten out, thereby effectively increasing the length thereof. In other words, the discharge end of hose 36 moves with concrete conduit 46 as the boom assembly is extended. The rigid concrete conduit connects the hose 36 to the conduit 62. The pivotal and rotation movement of the conduit 62 permits the boom assembly to be extended into low windows or openings in a building with the conduit 62 being able to pivot or rotate around posts, columns, etc. The apparatus is also able to: dump concrete close to the truck if desired.

FIGS. 10–15 illustrate a second embodiment of the invention and the same reference numerals will be employed in FIGS. 10–15 as in FIGS. 1–9. The only differences between the apparatus of FIGS. 10–15 and the apparatus of FIGS. 1–9 is the addition of a lattice truss 100 and winch 102 to the concrete conduit 62 (jib boom member) and a change in the design of the support assembly 66.

Figure 10:
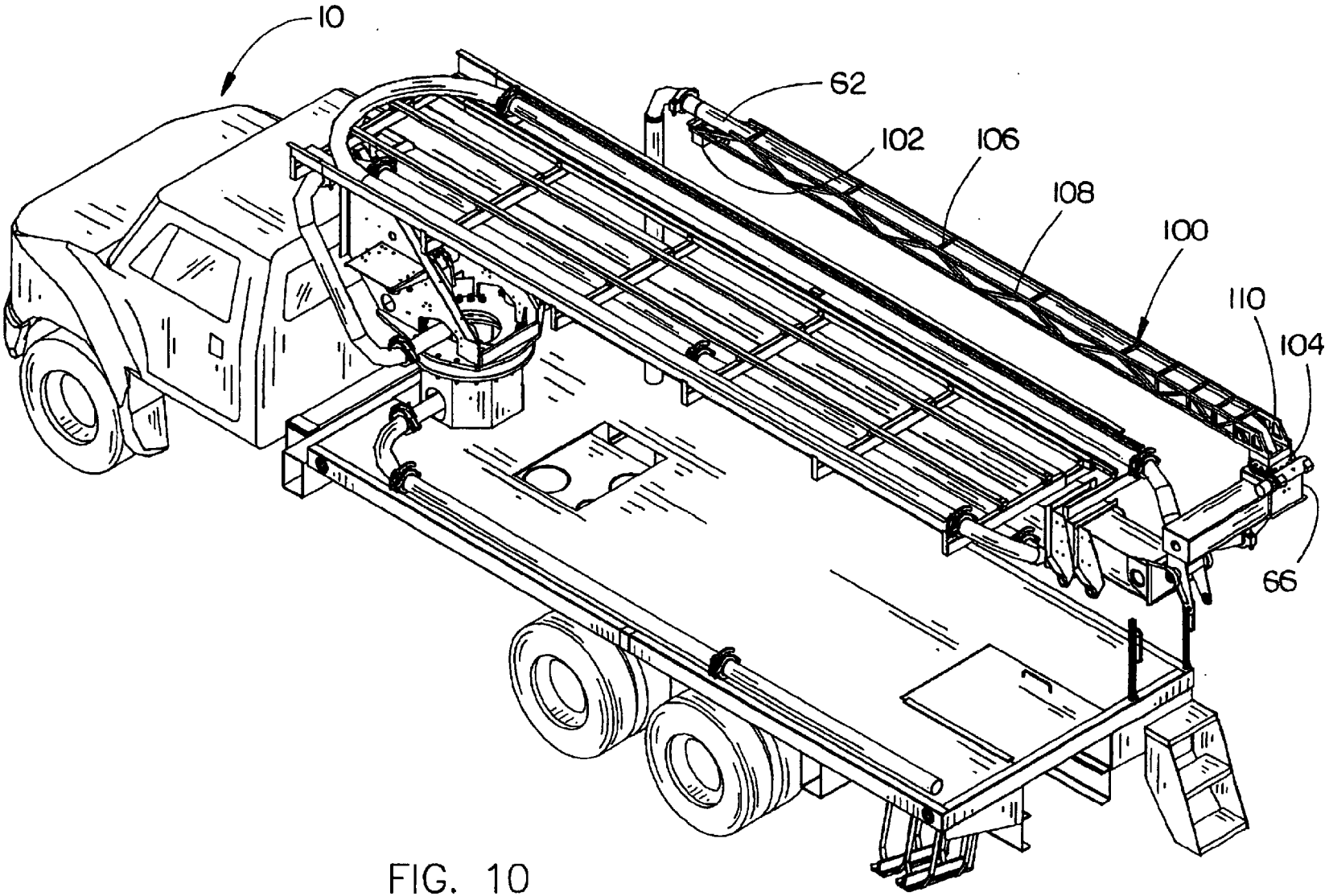
FIG. 10 is a rear perspective view of another embodiment of this invention wherein the jib boom member is positioned within and is secured to a lattice truss and which also illustrates a winch mounted on the outer end of the jib boom member.
Figure 11:
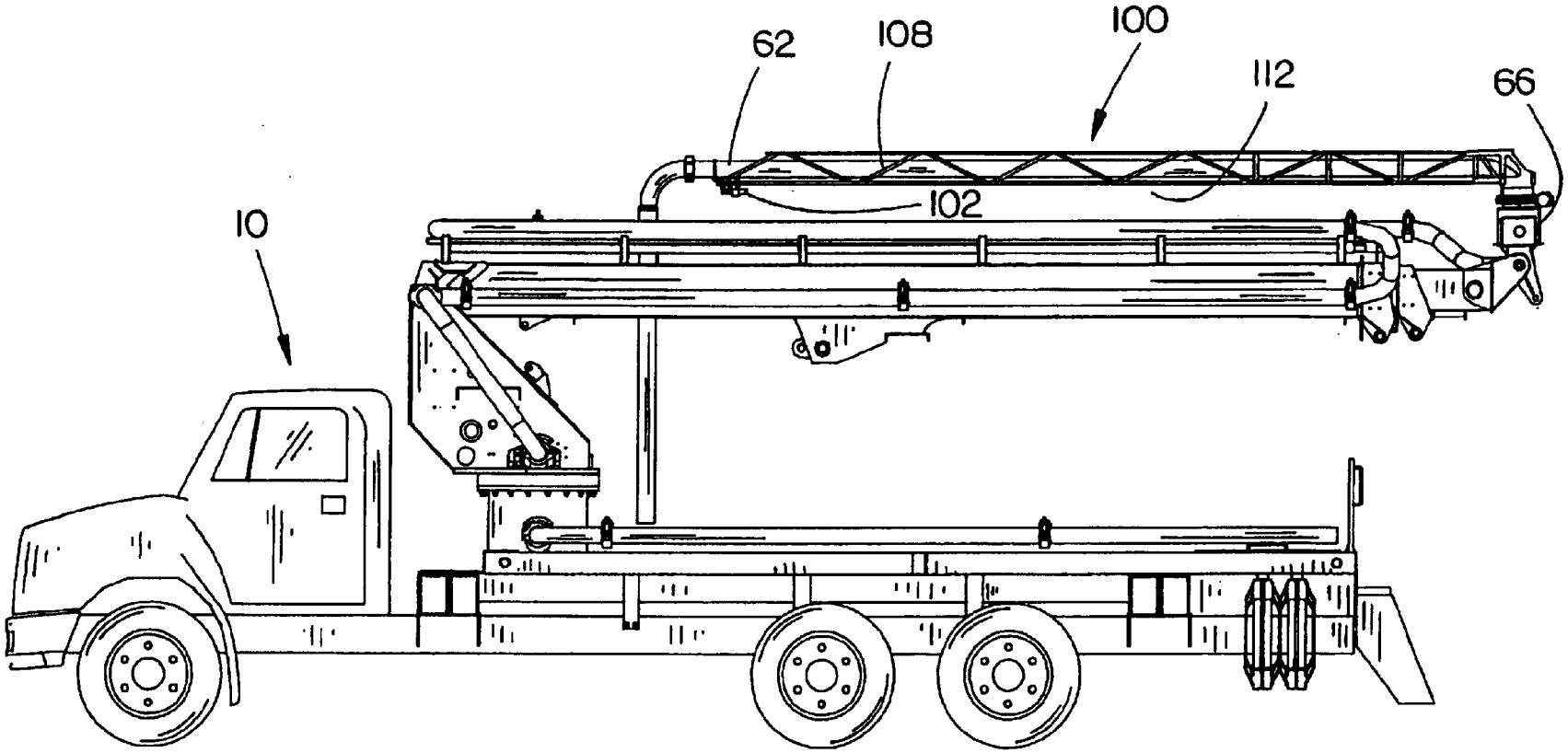
FIG. 11 is a side view of the apparatus of FIG. 10.
Figure 12:
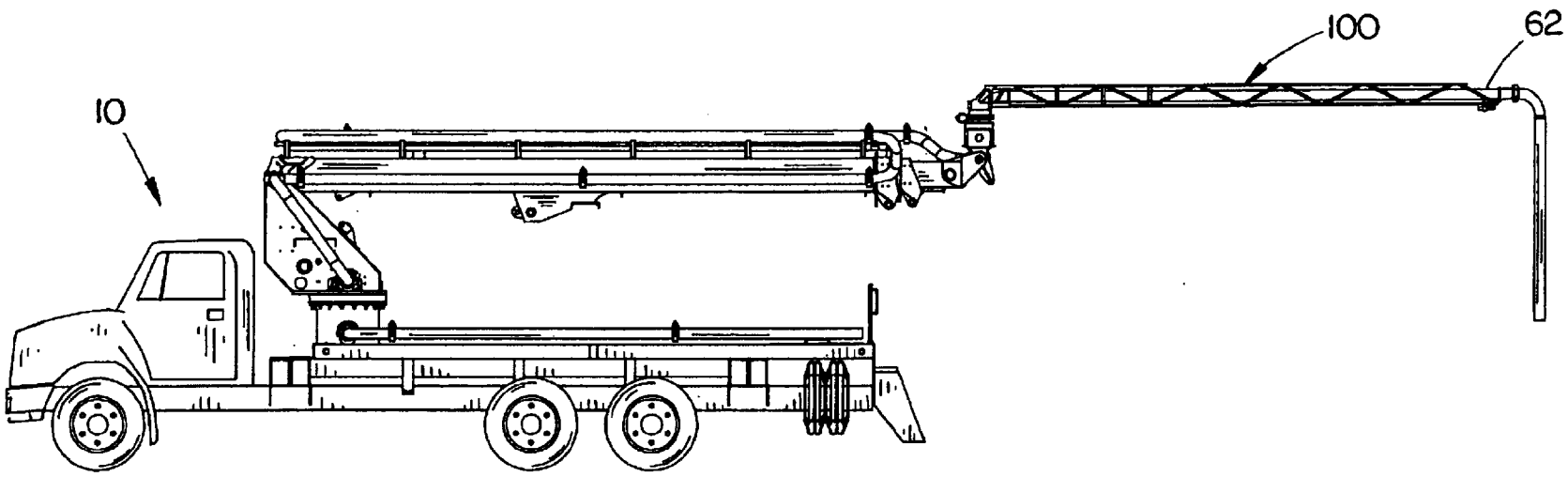
FIG. 12 is a side view of the apparatus of FIG. 10 with the jib boom member extended.
Figure 13:
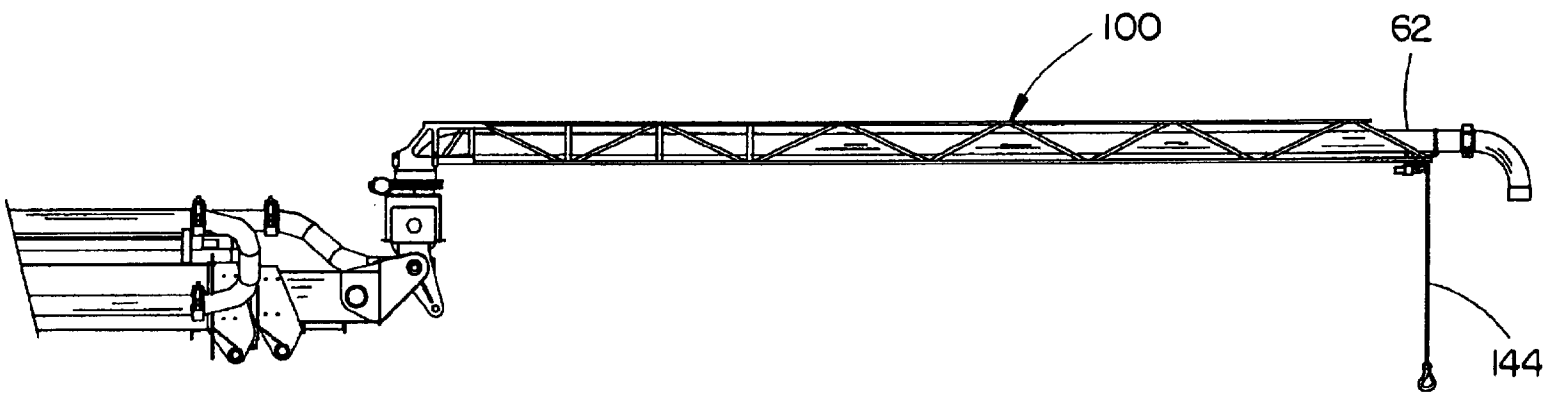
FIG. 13 is a partial side view of the apparatus of FIG. 10 with the jib boom member extended and a winch cable extending downwardly from a winch mounted on the jib boom member.
Figure 14:
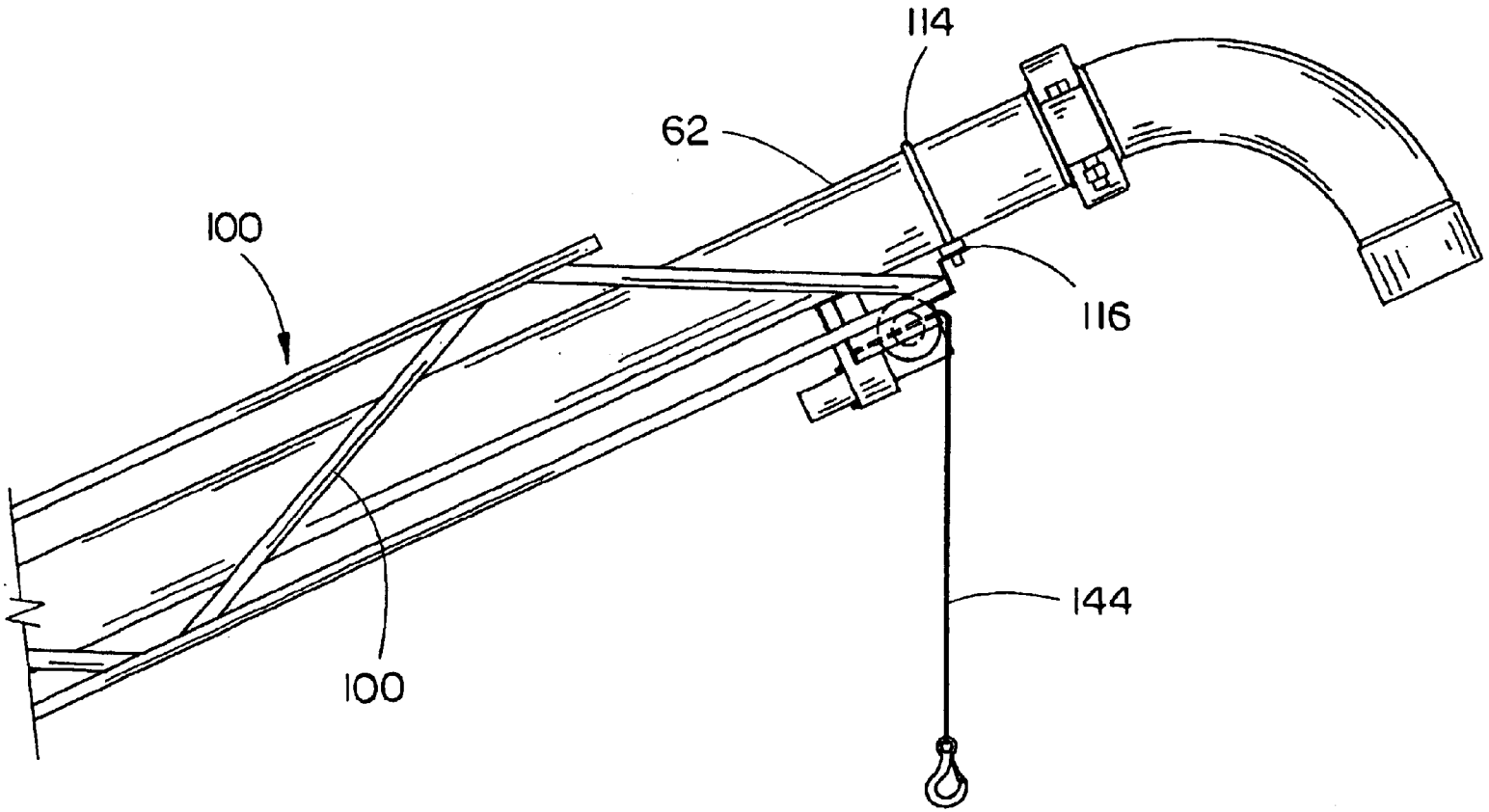
FIG. 14 is a partial side view of the outer end of the jib boom member of the apparatus of FIG. 10.
Figure 15:
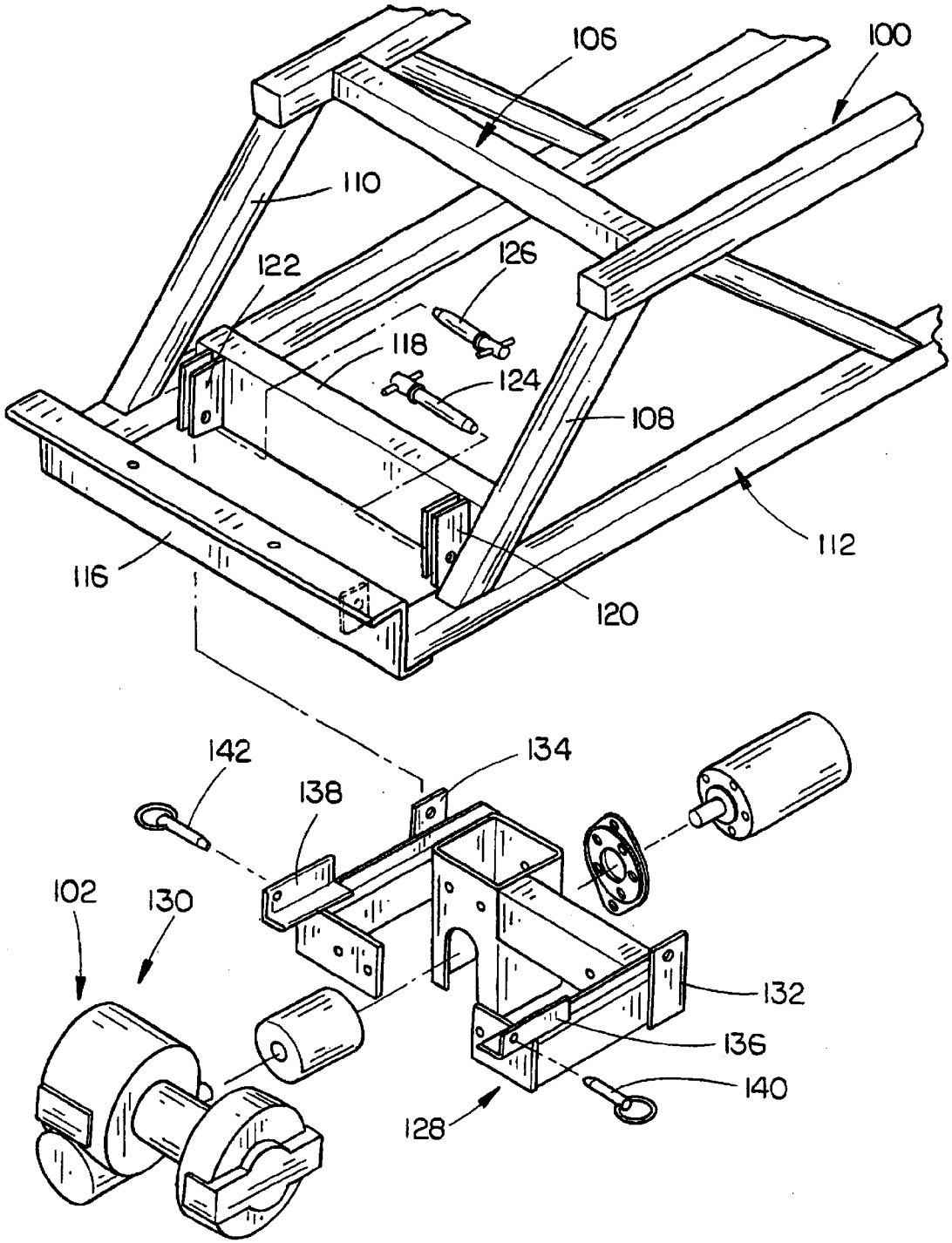
FIG. 15 is a partial exploded perspective view of the outer end of the lattice truss and winch.

As seen in FIG. 10, the inner end of the lattice truss 100 is secured to the support assembly at 104 and extends outwardly therefrom in a manner which encloses jib boom member 62. Truss 100 is a box-like truss and includes a top truss portion 106, side truss portions 108 and 110, and bottom truss portion 112. Side truss portions 108 and 110 extend between top truss portion 106 and bottom truss portion 112. The outer end of truss 100 is secured to jib boom member 62 by a U-bolt assembly 114. (FIG. 14). U-bolt assembly 114 extends around jib boom member 62 and is secured to frame member 116.

A frame member 118 is provided near the outer end of truss 100 (FIG. 15) and has mounting brackets 120 and 122 secured thereto adapted to receive lock pins 124 and 126 therein, respectively. Winch support frame 128 support a winch assembly 130 thereon. Winch support frame 128 includes a pair of ears 132 and 134 at its inner end which are adapted to be selectively removably secured to the mounting brackets 120 and 122, respectively, by the lock pins 124 and 126, respectively. The outer end of support frame 128 includes a pair of angles 136 and 138 which are adapted to be selectively removably secured to the truss 100 by pins 140 and 142, respectively. The structures just described enables the winch assembly 130 to be selectively removably mounted on the outer end of the truss 100 to provide a winch at the outer end of the jib boom member 62. The winch assembly includes a hoisting cable 144 which may be used to maneuver forms, rebars, etc. The truss 100 provides the necessary strength to the jib boom member 62 so that the winch may be supported thereby as well as whatever is being lifted by the hoisting cable 144. The removable aspect of the winch enables the winch to be secured to the jib boom member or removed therefrom as desired.

Thus it can be seen that the invention accomplishes at least all of its stated objectives.

I claim:

1. In combination:

a truck comprising a wheeled frame having rearward and forward ends, and a cab mounted on the forward end of said wheeled frame;

a rotatable pedestal assembly mounted on said wheeled frame rearwardly of said cab;

a telescopic boom assembly having inner and outer ends;

said boom assembly having its inner end pivotally secured, about a horizontal axis, to said pedestal;

a first hydraulic cylinder pivotally connecting said telescopic boom assembly to said pedestal for pivotally moving said telescopic boom assembly with respect to said pedestal;

said telescopic boom assembly comprising an inner first boom member having inner and outer ends and first and second sides, at least one intermediate boom member, having inner and outer ends, telescopically mounted in said inner boom member which is movable between retracted and extended positions with respect to said inner boom member, and an outer boom member having inner and outer ends, telescopically mounted in said intermediate boom member, which is movable between retracted and extended positions with respect to said intermediate boom member;

said outer boom member being movable with said intermediate boom member as said intermediate boom member is retracted and extended;

a first concrete conduit, having inner and outer ends, positioned at said first side of said inner boom member;

said inner end of said first concrete conduit being positioned at said inner end of said inner boom member;

said outer end of said first concrete conduit being positioned at said outer end of said inner boom member;

said inner end of said first concrete conduit being in communication with a source of concrete under pressure;

an elongated, flexible concrete hose having first and second ends;

said first end of said flexible concrete hose being operatively connected to said outer end of said first concrete conduit;

a first elongated support, having inner and outer ends, mounted on said inner boom member at said first side thereof;

a second elongated support, having inner and outer ends, mounted on said inner boom member at said second side thereof;

a third elongated support, having inner and outer ends, movably mounted on said second elongated support;

said third elongated support being movable between retracted and extended positions with respect to said second elongated support;

said outer end of said third elongated support being operatively secured to said outer end of said intermediate boom member so that said third elongated support moves from its said retracted position to its said extended position as said intermediate boom member is moved from its said retracted position to its said extended position;

a second concrete conduit, having inner and outer ends;

said inner end of said second concrete conduit being in fluid communication with said second end of said flexible concrete hose;

said second concrete conduit being secured to said outer end of said outer boom member for movement therewith;

said second concrete conduit being positioned on said third elongated support when said outer boom member is in its said retracted position;

said second concrete conduit extending from said outer end of said third elongated support when said outer boom member is in its said extended position;

said flexible concrete hose being positioned on said first elongated support and at least partially upon said second elongated support when said intermediate and outer boom members are in their said retracted positions;

a concrete discharge conduit operatively secured to said outer end of said second concrete conduit;

said concrete discharge conduit comprising a rigid jib boom member, having inner and outer ends, pivotally secured to the outer end of said outer boom member;

and a supporting truss, having inner and outer ends, associated with said rigid jib boom.

2. The combination of claim 1 wherein said supporting truss comprises a lattice truss.

3. The combination of claim 2 wherein said jib boom member is secured to and is positioned within said lattice truss.

4. The combination of claim 3 wherein said rigid jib boom member includes a self-aligning mechanism which normally maintains said rigid jib boom member in an aligned relationship with respect to said inner boom member.

5. The combination of claim 3 wherein a flexible concrete discharge hose is secured to said outer end of said rigid jib boom member.

6. The combination of claim 1 wherein said flexible concrete hose is generally U-shaped when the intermediate boom member and said outer boom member are in their said retracted positions.

7. The combination of claim 1 wherein said first elongated support is generally L-shaped in cross section.

8. The combination of claim 1 wherein said second elongated support is generally U-shaped in cross section.

9. The combination of claim 1 wherein said third elongated support is generally U-shaped in cross section.

10. The combination of claim 1 wherein said first concrete conduit comprises a rigid pipe.

11. The combination of claim 1 wherein said third concrete conduit comprises a rigid pipe.

12. The combination of claim 1 wherein said concrete discharge conduit comprises a rigid jib boom member pivotally and rotatably secured to the outer end of said outer boom member.

13. The combination of claim 1 wherein a winch means is secured to said outer end of said supporting truss.

14. The combination of claim 2 wherein a winch means is secured to said outer end of said lattice truss.

15. The combination of claim 14 wherein said winch means is selectively removably secured to said lattice truss.

16. The combination of claim 3 wherein a winch means is secured to, said outer end of said lattice truss.

17. The combination of claim 16 wherein said winch means is selectively removably secured to said lattice truss.

18. In combination:

a truck comprising a wheeled frame having rearward and forward ends, and a cab mounted on the forward end of said wheeled frame;

a rotatable pedestal assembly mounted on said wheeled frame rearwardly of said cab;

a telescopic boom assembly having inner and outer ends;

said boom assembly having its inner end pivotally secured, about a horizontal axis, to said pedestal;

a first hydraulic cylinder pivotally connecting said telescopic boom assembly to said pedestal for pivotally moving said telescopic boom assembly with respect to said pedestal;

said telescopic boom assembly comprising an inner first boom member having inner and outer ends and first and second sides, at least one intermediate boom member, having inner and outer ends, telescopically mounted in said inner boom member which is movable between retracted and extended positions with respect to said inner boom member, and an outer boom member having inner and outer ends, telescopically mounted in said intermediate boom member, which is movable between retracted and extended positions with respect to said intermediate boom member;

said outer boom member being movable with said intermediate boom member as said intermediate boom member is retracted and extended;

a first concrete conduit, having inner and outer ends, positioned at said first side of said inner boom member;

said inner end of said first concrete conduit being in communication with a source of concrete under pressure;

an elongated, flexible concrete hose having first and second ends;

said first end of said flexible concrete hose being operatively fluidly connected to said outer end of said first concrete conduit;

a first elongated support, having inner and outer ends, mounted on said inner boom member at said first side thereof;

a second elongated support, having inner and outer ends, mounted on said inner boom member at said second side thereof;

a third elongated support, having inner and outer ends, movably mounted on said second elongated support;

said third elongated support being movable between retracted and extended positions with respect to said second elongated support;

said outer end of said third elongated support being operatively secured to said intermediate boom member so that said third elongated support moves from its said retracted position to its said extended position as said intermediate boom member is moved from its said retracted position to its said extended position;

a second concrete conduit, having inner and outer ends;

said inner end of said second concrete conduit being in fluid communication with said second end of said flexible concrete hose;

said second concrete conduit being operatively secured to said outer end of said outer boom member for movement therewith;

said second concrete conduit being positioned on said third elongated support when said outer boom member is in its said retracted position;

said second concrete conduit extending from said outer end of said third elongated support when said outer boom member is in its said extended position;

said flexible concrete hose being positioned on said first elongated support and at least partially upon said second elongated support when said intermediate and outer boom members are in their said retracted positions;

a concrete discharge conduit operatively secured to said outer end of said second concrete conduit;

said concrete discharge conduit comprising a rigid jib boom member, having inner and outer ends, pivotally secured to the outer end of said outer boom member;

and a supporting truss, having inner and outer ends, associated with said rigid jib boom.

19. The combination of claim 18 wherein said supporting truss comprises a lattice truss.

20. The combination of claim 19 wherein said jib boom member is secured to and is positioned within said lattice truss.

21. The combination of claim 19 wherein a winch means is secured to said outer end of said lattice truss.

22. The combination of claim 19 wherein said winch means is selectively removably secured to said lattice truss.

23. The combination of claim 18 wherein said rigid jib boom member includes a self-aligning mechanism which normally maintains said rigid jib boom member in an aligned relationship with respect to said inner boom member.

24. The combination of claim 18 wherein a flexible concrete discharge hose is secured to said outer end of said rigid jib boom member.

25. The combination of claim 18 wherein said flexible concrete hose is generally U-shaped when the intermediate boom member and said outer boom member are in their said retracted positions.

26. The combination of claim 18 wherein said first elongated support is generally L-shaped in cross section.

27. The combination of claim 18 wherein said second elongated support is generally U-shaped in cross section.

28. The combination of claim 18 wherein said third elongated support is generally U-shaped in cross section.

29. The combination of claim 18 wherein said first concrete conduit comprises a rigid pipe.

30. The combination of claim 18 wherein said third concrete conduit comprises a rigid pipe.

31. The combination of claim 18 wherein said concrete discharge conduit comprises a rigid jib boom member pivotally and rotatably secured to the outer end of said outer boom member.

32. The combination of claim 31 wherein the pivotal axis and the rotational axis of said jib boom member are transversely disposed with respect to one another.

33. In combination:

a truck comprising a wheeled frame having rearward and forward ends, and a cab mounted on the forward end of said wheeled frame;

a rotatable pedestal assembly mounted on said wheeled frame rearwardly of said cab;

a telescopic boom assembly having inner and outer ends said boom assembly having its inner end pivotally secured, about a horizontal axis, to said pedestal;

said telescopic boom assembly being movable between retracted and extended positions;

a concrete conduit means, having inner and outer ends, positioned on said boom assembly;

said inner end of said concrete conduit means being positioned at said inner end of said boom assembly;

said outer end of said concrete conduit means being positioned at said outer end of said boom assembly;

said inner end of said concrete conduit means being in communication with a source of concrete under pressure;

a concrete discharge conduit operatively secured to said outer end of said concrete conduit means;

said concrete discharge conduit comprising a rigid jib boom member, having inner and outer ends, pivotally secured to the outer end of said boom assembly;

and a jib boom supporting truss, having inner and outer ends, associated with said jib boom member.

34. The combination of claim 33 wherein said jib boom supporting truss comprises a lattice truss.

35. The combination of claim 34 wherein said jib boom member is secured to and is positioned within said lattice truss.

36. The combination of claim 33 wherein said rigid jib boom member includes a self-aligning mechanism which normally maintains said rigid jib boom member in an aligned relationship with respect to said boom assembly.

37. The combination of claim 33 wherein a flexible concrete discharge hose is secured to said outer end of said rigid jib boom member.

38. The combination of claim 33 wherein a winch means is mounted on the outer end of said supporting truss.

39. The combination of claim 38 wherein said winch means is selectively removably mounted on said truss.

40. The combination of claim 34 wherein a winch means is mounted on the outer end of said lattice truss.

41. The combination of claim 40 wherein said winch means is selectively removably mounted on said lattice truss.

42. The combination of claim 35 wherein a winch means is mounted on the outer end of said lattice truss.

43. The combination of claim 42 wherein said winch means is selectively removably mounted on said lattice truss.

44. The combination of claim 40 wherein said concrete discharge conduit comprises a rigid jib boom member pivotally and rotatably secured to the outer end of said boom assembly.

45. The combination of claim 44 wherein the pivotal axis and the rotational axis of said jib boom member are transversely disposed with respect to one another.

* * * * *